US007201193B1

(12) United States Patent
Skendzel

(10) Patent No.: US 7,201,193 B1
(45) Date of Patent: Apr. 10, 2007

(54) PROCESS FOR TREATING WOOD WITH A MIXTURE OF GARNET PARTICLES AND GLASS BEADS

(75) Inventor: Gary Skendzel, Berthoud, CO (US)

(73) Assignee: Loveland Screw Machine, Ltd., Berthoud, CO (US)

( * ) Notice: Subject to any disclaimer, the term of this patent is extended or adjusted under 35 U.S.C. 154(b) by 267 days.

(21) Appl. No.: 10/894,821

(22) Filed: Jul. 19, 2004

Related U.S. Application Data

(60) Provisional application No. 60/488,563, filed on Jul. 17, 2003, provisional application No. 60/581,059, filed on Jun. 18, 2004.

(51) Int. Cl.
*B27M 3/00* (2006.01)
*B24C 1/00* (2006.01)

(52) U.S. Cl. ..... 144/358; 451/38; 144/361

(58) Field of Classification Search ..... 144/329, 144/358, 361, 363, 364, 380, 359; 51/293, 51/307, 309; 492/37; 451/38, 39
See application file for complete search history.

(56) References Cited

U.S. PATENT DOCUMENTS

| | | | | |
|---|---|---|---|---|
| 649,978 | A | 5/1900 | Buyton | |
| 2,345,942 | A | 4/1944 | Lehman | |
| 3,580,311 | A * | 5/1971 | Fox, Jr. | 144/329 |
| 3,967,007 | A * | 6/1976 | Lee | 427/223 |
| 4,821,461 | A | 4/1989 | Holmstrand | |
| 5,257,655 | A | 11/1993 | Skendzel | |

* cited by examiner

*Primary Examiner*—Shelley Self
(74) *Attorney, Agent, or Firm*—William W. Cochran; Cochran Freund & Young LLC

(57) ABSTRACT

A process for treating wood to create a worn appearance. The process involves impacting the surface of the wood with a mixture of garnet particles and glass beads sufficiently to cause the soft rings to wear away at a rate greater than the hard rings.

2 Claims, 2 Drawing Sheets

PROCESS FOR TREATING WOOD WITH A MIXTURE OF GARNET PARTICLES AND GLASS BEADS

CROSS REFERENCE TO RELATED APPLICATIONS

The present application is based upon and claims the benefit of U.S. Provisional Patent Application Ser. No. 60/488,563 by Gary Skendzel, entitled "Process for treating wood with a mixture of garnet particles and glass beads" filed Jul. 17, 2003, and U.S. Provisional Patent Application Ser. No. 60/581,059 by Gary Skendzel, entitled "Process for treating wood with a mixture of garnet particles and glass beads" filed Jun. 18, 2004, the entire contents of which is hereby specifically incorporated by reference for all they discloses and teach.

BACKGROUND OF THE INVENTION a. Field of the Invention

This invention relates to processes and techniques for treating wood and more particularly to processes and techniques for treating wood to give it a worn or weathered appearance.

b. Description of the Background

Wood is commonly used for framing artwork, photographs, plaques, clocks and other decorative items. Sometimes the wood is sanded and stained to provide a smooth finish with a high gloss. Some people prefer to sand the wood to make it smooth and then paint it.

A particularly attractive type of wood for use in artwork or in frames around artwork, photographs, clocks, etc. is worn or weathered wood, such as driftwood. This type of wood is very attractive because it has been naturally weathered by the environment. When wood is weathered naturally, it takes on a grooved or roughened appearance. This is because the wood includes rings or sections which are of different hardness that have been weathered at different rates as a result of exposure to the environment. The naturally occurring rings in the wood alternate between relatively hard (resulting from the cold season) and relatively soft (resulting from the warm season). During natural weathering, the soft rings are eroded away at a faster rate than the hard rings. As a result, the hard rings form ridges and the softer rings are weathered and worn away to leave grooves or depressions between the hard rings.

Because the supply of naturally occurring driftwood is limited, it would be advantageous to have a technique for modifying ordinary wood to simulate the appearance of driftwood. Some have tried using the technique of sandblasting ordinary wood to modify its appearance. However, the result is not entirely satisfactory because the sand tends to wear away the wood in a manner such that both the hard rings and soft rings are worn down. Although a rough surface remains, it does not simulate driftwood in appearance. The sand also tends to pit the wood in an undesirable manner.

A process of using glass beads to create a weathered or worn appearance in wood is disclosed in U.S. Pat. No. 5,257,655, which is specifically incorporated herein by reference for all that it discloses and teaches. As disclosed in that patent, glass beads have successfully been used to abrade wood so that the soft rings are preferentially worn away leaving the harder rings to create the weathered or worn appearance. Although that process has been successfully used with glass beads, the abrasion process using strictly glass beads can be somewhat lengthy.

SUMMARY OF THE INVENTION

The present invention overcomes the disadvantages and limitations of the prior art by providing a process for treating wood to simulate naturally occurring worn wood such as driftwood or weathered wood. This is accomplished by impacting the wood with a propellant and an abrading material, that is a mixture of garnet particles and glass beads, or garnet particles alone, at a speed and for a time sufficient to abrade or wear away the soft rings in the wood at a rate that is greater than the abrasion rate of the hard rings in the wood. The garnet particles help in the cutting process while the glass beads prevent a rough finish or rough texture from forming on the wood. The propellant may consist of pressurized air, pressurized air and water vapor, other liquid vapor, or a pressurized liquid. The propellant can be premixed with the abrading material, i.e. the mixture of glass beads and garnet, or can be mixed at the nozzle of the gun.

The present invention may therefore comprise of a process for treating wood, wherein the wood includes a grain comprising hard rings separated by soft rings, the process comprising: impacting the wood with a mixture of garnet particles and glass beads at a speed and for a time sufficient to wear away the soft rings at a rate greater than the hard rings wherein the garnet particles and the glass beads are of a size that is small enough to pass through a 140 mesh and the garnet particles are at least approximately 40 percent by volume of the mixture.

The advantages of the present invention are that a weathered or worn appearance can be created on woods such as Pine and/or any woods in which the hard rings are substantially harder than the soft rings such that the soft rings abrade more quickly than the hard rings to create the appearance of a worn or weathered look such as driftwood. The mixture of garnet particles and glass beads allows woods to be cut quickly without causing pitting and preferentially cutting the soft rings as opposed to the hard rings to create the weathered appearance.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Embodiments of the processes of the present invention are illustrated in the accompanying drawings. A block or piece of wood 10 to be treated comprises alternating hard rings 12 and soft rings 14. The hard rings may be caused by cold seasons and the soft rings are caused by warm seasons.

Figure 2:
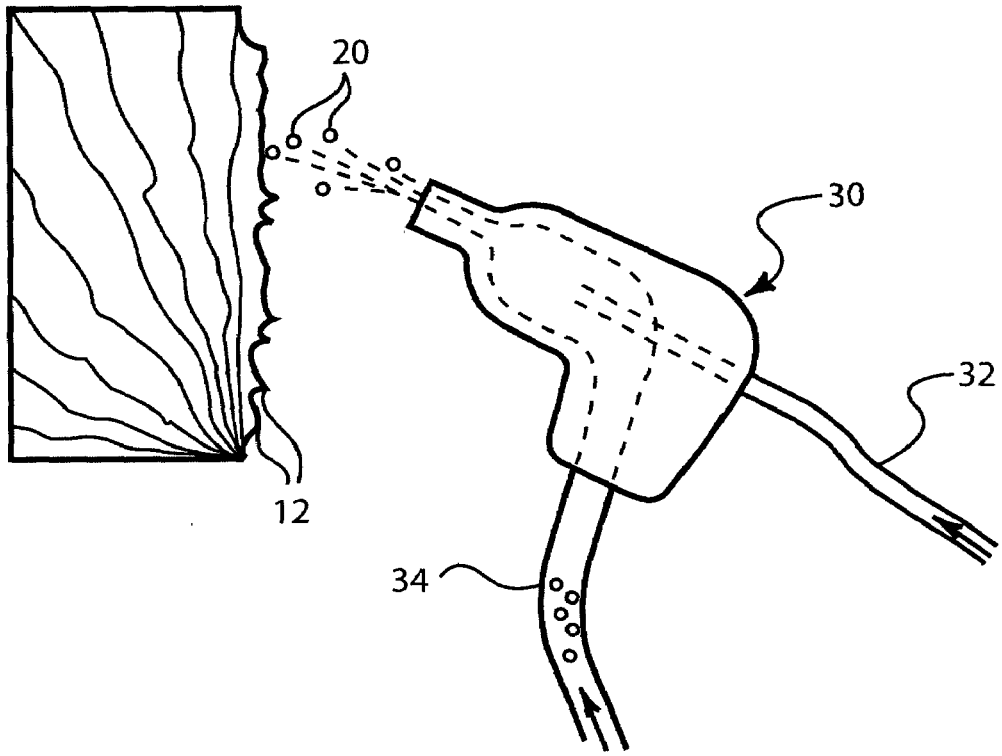
FIG. 2 is a side elevational view illustrating one mode of the process of the invention.

A mixture of garnet particles and glass beads 20 are directed against the surface of the wood at high speed. The mixture impacts the surface of the wood and wears away the soft rings at a rate greater than the hard rings. The resulting appearance of the wood is very attractive and is remarkably similar to naturally occurring driftwood. The resulting grooved surface is not pitted. Rather, the surface of the wood remains smooth. Preferably the mixture is propelled against the wood surface by means of a jet or stream of pressurized air or a mixture of air and water vapor, water or other liquid (propellant). A convenient manner of doing this is by means of a conventional mixing gun 30, as shown in FIG. 2. A line 32 supplying pressurized propellant is connected to the gun. Another line 34 supplying glass beads is also connected to the gun. The pressurized propellant passing through the gun creates suction in line 34 to draw the garnet particles and glass beads into the gun where they are mixed with the pressurized propellant and then forced out of the nozzle.

In one embodiment, the air pressure used is in the range of about 40 to 200 psi when using the conventional mixing gun shown in FIG. 2. Below about 40 psi the process is slow. At pressures above about 200 psi, the glass beads may tend to break in the orifice of the mixing gun.

The glass beads are spherical and preferably solid. The diameter of the beads may range from about 0.002 to 0.01 inch. Diameters of about 0.006 inches have been found, in one embodiment, to be an effective size for mixing with the garnet particles. Garnet particles having U.S. mesh size of 60, 80, 120 and 140 provide effective cutting. However, the smaller mesh numbers (larger size particles) create a rougher and more pitted finish. Hence, the larger mesh numbers, such as U.S. mesh 140, allow for rapid cutting of the wood and provide a smoother finish. Glass beads passing through mesh numbers of 140 mixed with garnet particles passing through mesh numbers of 140 provide an effective mixture for both cutting the wood in a rapid manner and providing a smoother finish.

Mixtures of 50 percent garnet and 50 percent glass, by volume, provide both rapid cutting ability and a smooth finish, especially when mesh numbers of 140 or greater are used for both the garnet particles and glass beads. However, other mixtures such as 40 percent garnet particles and 60 percent glass also provide reasonable cutting speed and a somewhat smoother finish, without pitting. Of course, any desired mixture of glass beads and garnet particles can be used to obtain the desired results. The cutting speed increases as the size of the garnet particles increases. However, as noted above, a rougher finish is created by the larger size garnet particles. Similarly, the cutting speed of the glass beads increases with the size of the glass beads. Hence, a mixture of sizes can be used for the garnet particles and the glass beads that provides the desired properties of cutting speed and texture desired by the user. The specific gravity of the glass beads may be in the range of about 2.45 to 2.50.

The type of wood used may be Pine because in such wood there is a significant difference between the hardness of the hard rings and the soft rings. Other types of wood have a distinct difference in ring hardness can also be used, of course. Harder woods can be cut more quickly using the present invention.

Figure 1:
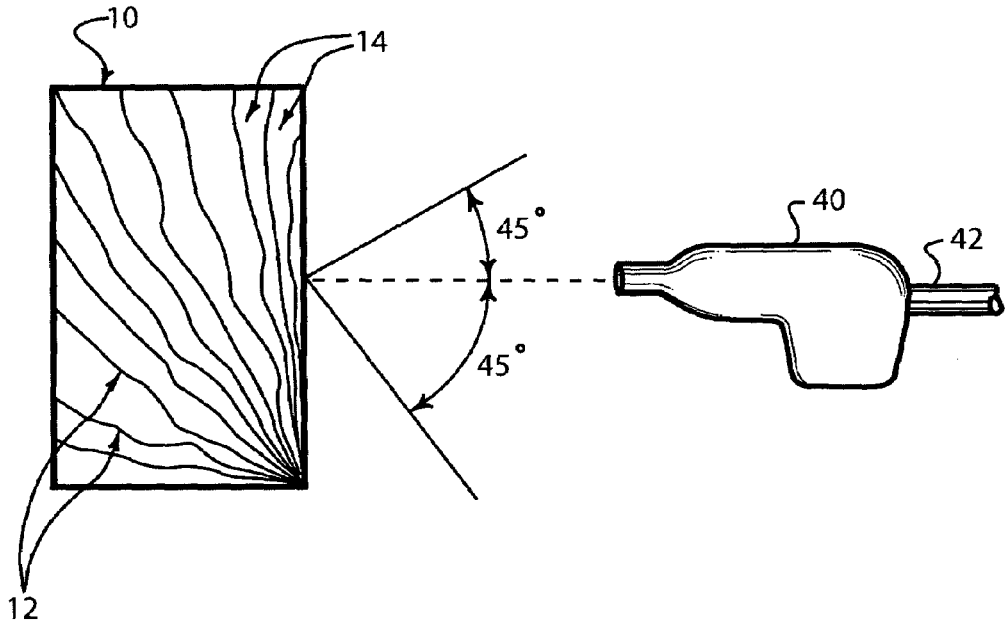
FIG. 1 is a side elevational view illustrating the preferred angles of impact of the glass beads on the wood to be treated.

As illustrated in FIG. 1, the mixture of garnet particles and glass beads should be directed at the surface of the wood within an angle of about 45° with respect to a line perpendicular to the surface of the wood. The gun may be held very close to the surface of the wood (e.g., one inch), or it may be held several inches away (e.g., 12 inches).

In the embodiment shown in FIG. 1, the gun 40 is connected to a supply line 42 for supplying both pressurized propellant and a mixture of garnet particles and glass beads to the gun. This embodiment is useful when the mixture of garnet particles and glass beads and pressurized propellant are contained in a kettle or chamber and then are vented through line 42 to the nozzle or gun 40. For this type of apparatus, the air pressure may be in the range of about 7 to 200 psi.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A process for treating wood, wherein said wood includes a grain comprising hard rings separated by soft rings, the process comprising: impacting said wood with a mixture of garnet particles and glass beads at a speed and for a time sufficient to wear away said soft rings at a rate greater than said hard rings wherein said garnet particles and said glass beads are of a size that is small enough to pass through approximately a 140 mesh and said garnet particles are approximately at least 40 percent by volume of said mixture.

2. A process for treating wood, wherein said wood includes a grain comprising hard rings separated by soft rings, the process comprising: impacting said wood with a mixture of garnet particles and glass beads at a speed and for a time sufficient to wear away said soft rings at a rate greater than said hard rings wherein said garnet particles and said glass beads are of a size that is small enough to pass through approximately a 60 mesh and said garnet particles are approximately at least 40 percent by volume of said mixture.

* * * * *